United States Patent [19]

Stemen

[11] 4,245,750

[45] Jan. 20, 1981

[54] NON-REMOVABLE DRUM SIDE HANDLE

[75] Inventor: Michael J. Stemen, Van Wert, Ohio

[73] Assignee: The Continental Group, Inc., New York, N.Y.

[21] Appl. No.: 905,923

[22] Filed: May 15, 1978

[51] Int. Cl.[3] ..... A47B 95/02; B65D 5/46; B65D 25/22

[52] U.S. Cl. ..... 220/94 R; 229/52 AW; 16/126

[58] Field of Search ..... 229/47, 5.6, 52 AW, 229/52 AL; 220/94; 16/125, 126, 110 R

[56] References Cited

U.S. PATENT DOCUMENTS

| | | | |
|---|---|---|---|
| 369,832 | 9/1887 | Bardell | 220/94 R |
| 964,720 | 7/1910 | Wegner | 220/94 R |
| 3,199,719 | 8/1965 | Fronczek | 229/52 AW X |
| 3,261,053 | 7/1966 | Lesher | 16/126 |
| 3,683,452 | 8/1972 | Rickmeien, Jr. | 16/126 |

FOREIGN PATENT DOCUMENTS

| | | | |
|---|---|---|---|
| 1492976 | 7/1967 | France | 229/52 AL |

*Primary Examiner*—Davis T. Moorhead
*Attorney, Agent, or Firm*—Charles E. Brown

[57] ABSTRACT

A side handle arrangement for drums particularly of the fibre drum type wherein the upper end of the drum body is provided with a reinforcing metal chime. The handle assembly includes a hinge member formed by a strap having an upper portion disposed between and interlocked with the drum body and chime and a lower portion disposed adjacent the lower edge of the chime in the form of a sleeve. The handle has a pin portion which extends into and is journalled in the sleeve.

7 Claims, 4 Drawing Figures

FIG.1
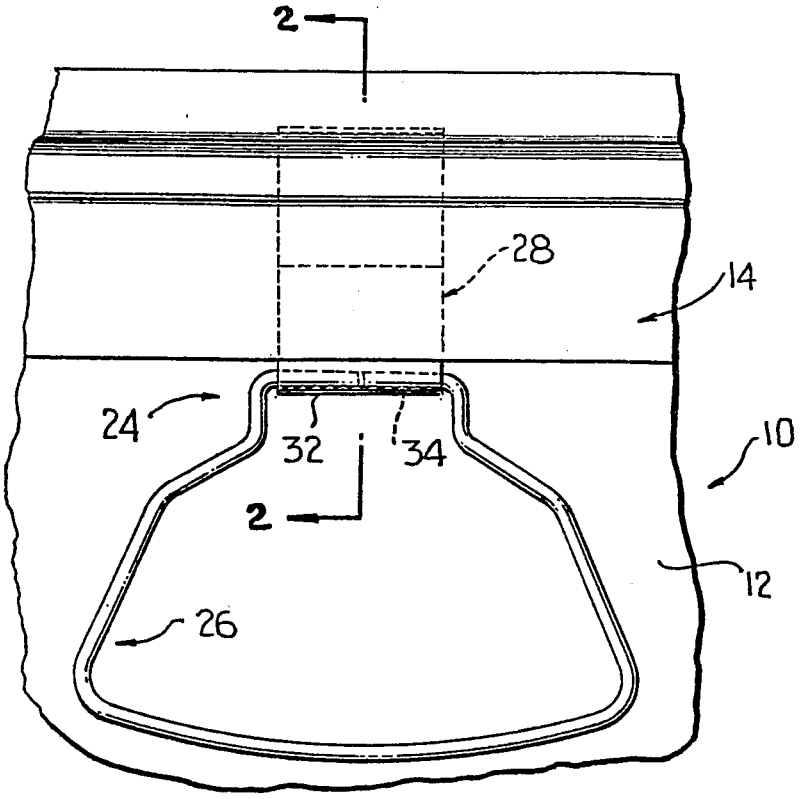
FIG.2
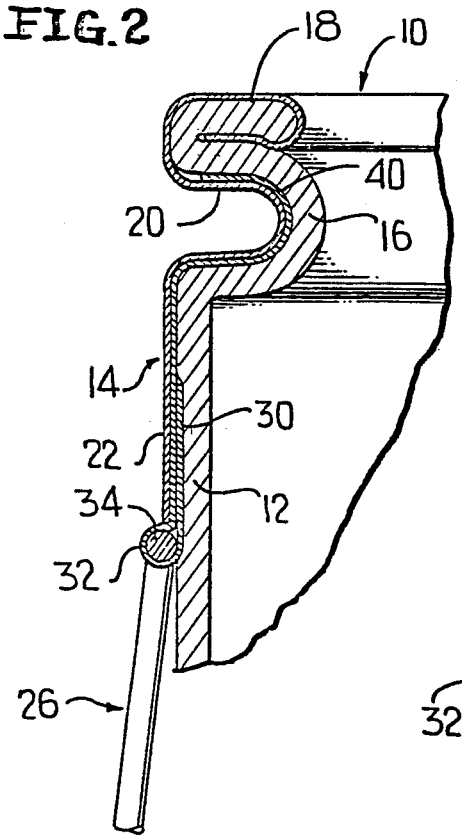
FIG.3
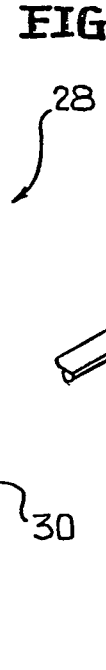
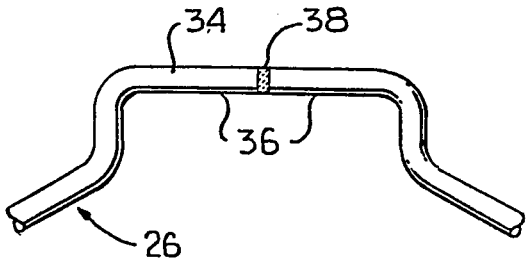
FIG.4

NON-REMOVABLE DRUM SIDE HANDLE

This invention relates in general to new and useful improvements in handle assemblies, and more particularly to a handle assembly particularly adapted for attachment to a fibre drum.

In the past, fibre drums have been provided with handle assemblies of two basic types. The metal chime reinforcing the upper end of the fibre drum may be provided with struck-out sleeve portions in which pin end portions of a handle may be engaged. On the other hand, a hinge forming member may be suitably secured to the drum body by riveting or to the chime by welding.

In accordance with this invention, there is provided a simple handle assembly wherein the hinge sleeve is part of a strap which is assembled with the drum body at the time the metal chime is applied thereto. This greatly simplifies assembly and provides for a positive and permanent interlock of the handle assembly with the drum.

Most specifically, the chime and drum have reversely turned interlocked portions which extend circumferentially about the drum and the upper part of the strap which defines the hinge sleeve is also of a reversely bent configuration and is interlocked between the reversely turned portions of the drum body and chime so as positively to prevent withdrawal of the strap.

The lower end of the strap carrying the hinge sleeve is also reversely turned so that the terminal lower edge portion of the strap is doubled upon itself and is clamped between the chime and the drum body so as to prevent deformation of the sleeve.

The handle per se may be of any construction, but preferably is formed of wire or rod material and includes a pin portion which is journalled within the sleeve, the pin portion being preferably defined by terminal end portions of the handle which may be welded together so as to provide a permanent interlock between the handle and the sleeve.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a fragmentary side elevational view of a fibre drum having a handle assembly formed in accordance with this invention.

FIG. 2 is a vertical radial sectional view taken generally along the line 2—2 of FIG. 1, and shows specifically the details of the connection between the hinge assembly and the drum.

FIG. 3 is a side elevational view of a strap portion of the hinge assembly prior to the deformation of the upper portion thereof for interlocking with the drum.

FIG. 4 is a fragmentary elevational view of the upper portion of the handle, and shows the manner in which the terminal portions thereof form a hinge pin.

Referring now to the drawings in detail, it will be seen that there is illustrated a conventional fibre drum which is generally identified by the numeral 10. The drum 10 includes a body 12 which is reinforced at the upper end thereof in a conventional manner by means of a circumferentially extending metal chime 14.

The radial vertical cross section of the upper portion of the drum body and chime may be varied, but basically there is a positive interlock between the chime and the drum body and the drum body and chime are configurated so as to provide for increased stiffness. Thus, the drum body 12 will normally have a reversely turned upper portion 16 underlying the upper terminal flange portion 18. This return bend projects radially inwardly into the interior of the drum. In a like manner, the chime 14 will have a return bend 20 which is normally seated within the return bend 16 of the drum body. Further, the chime will have a depending skirt portion 22.

In accordance with this invention, there is provided a handle assembly, generally identified by the numeral 24. The handle assembly 24 includes a handle member 26 and a retaining strap 28. The retaining strap 28 is preferably formed of sheet metal and includes a reversely bent lower portion including a terminal flange portion 30 which is doubled back onto the remainder of the strap and which is configurated to define a sleeve 32 extending generally to the opposite side of the strap from the flange portion 30.

The handle 26 may be of any desired configuration and is preferably formed of wire or rod material. The handle 26 has a portion thereof defining a hinge pin 34 and this hinge pin 34 is rotationally journalled within the sleeve 32. As is best shown in FIG. 4, preferably the hinge pin 34 is formed of two terminal portions 36 which are secured together as by welding 38. The terminal portions 36 will, of course, be in alignment with one another.

It is to be understood that the handle 26 is preferably first formed and the hinge pin 34 is snapped into the sleeve 32 by moving it down between the flange portion 30 and the remainder of the strap 28. The handle assembly 24 is now ready to be assembled with the componenets of the drum 10.

It is to be understood that the strap 28 is formed of light gauge metal which may be readily deformed and, accordingly, either the strap 28 may be preformed to have a return bend or may be shaped during its assembly with the drum components.

It is to be understood that the drum body 12 is first formed and then is assembled with the metal chime 14. During the assembling of the chime and the drum body, the strap 28 is positioned between the chime and the drum body in the manner specifically illustrated in FIG. 2.

It is to be noted that in the assembled drum, the upper portion of the strap 28 includes a return bend 40 which is disposed around the return bend 20 of the chime 14 and within the return bend 16 of the drum body 12. Thus, the strap 28 is permanently interlocked with the drum 10.

Next, it is to be seen that the flange 30 is disposed inwardly of the skirt 22 of the chime 12, and thus deformation of the sleeve 32 is prevented. It is also to be noted that the sleeve 32 is disposed closely adjacent the lower edge of the chime skirt so that deformation of the strap 28 above the sleeve 32 and below the chime 14 is prevented.

It will be readily apparent that while the handle assembly is on a non-removable construction and has all of the required structural strength, it is at the same time very simple so as to be not easily constructed, but also easily installed.

Although only a preferred embodiment of the handle assembly has been specifically illustrated and described herein, it is to be understood that minor variations may be made in the handle assembly without departing from the spirit and scope of the invention as defined by the appended claims.

I claim:

1. In combination with a drum having a body with an upper end portion thereof having a metal chime extending around said upper end portion, a handle assembly, said handle assembly comprising a separately formed strap formed of a rigid material and having an upper portion interlocked between said chime and said drum, said strap having a lower portion disposed below said chime, and a separately formed rigid handle hingedly carried by said strap lower portion.

2. In the combination of claim 1, said chime and said drum in radial longitudinal cross section being of a reversely turned configuration, and said strap having an upper portion of a like reversely turned configuration to provide a positive interlock between said strap and said drum body and chime.

3. In the combination of claim 2, said strap lower portion being in the form of a sleeve disposed adjacent said chime, and said handle including a hinge pin portion journalled in said sleeve.

4. In the combination of claim 3 wherein said strap sleeve portion is defined by a reversely turned lower portion, and said strap has an upwardly directed lower terminal end disposed between said drum body and said chime.

5. In the coombination of claim 4 wherein said strap is formed of sheet metal and said handle is formed of a single length of wire having terminal portions forming part of said hinge pin portion.

6. In the combination of claim 1, said strap lower portion being in the form of a sleeve disposed adjacent said chime, and said handle including a hinge pin portion journalled in said sleeve.

7. In the combination of claim 6 wherein said strap sleeve portion is defined by a reversely turned lower portion, and said strap has an upwardly directed lower terminal end disposed between said drum body and said chime.

* * * * *